United States Patent [19]

Patton et al.

[11] 4,153,146

[45] May 8, 1979

[54] EXPANDABLE LUGGAGE BAG

[75] Inventors: James S. Patton, Yardville, N.J.; Richard W. Housel, New Hope, Pa.

[73] Assignee: Atlantic Products Corporation, Trenton, N.J.

[21] Appl. No.: 855,648

[22] Filed: Nov. 30, 1977

[51] Int. Cl.[2] ..... A45C 7/00

[52] U.S. Cl. ..... 190/44; 190/41 Z

[58] Field of Search ..... 190/44, 21, 41 Z, 48

[56] References Cited

U.S. PATENT DOCUMENTS

| | | | |
|---|---|---|---|
| 1,934,360 | 11/1933 | Laufman | 190/41 Z |
| 1,974,872 | 9/1934 | Lunn | 190/41 Z |
| 2,030,360 | 2/1936 | Dyer | 190/41 Z |
| 2,078,624 | 4/1937 | Wolff | 190/44 |
| 2,182,879 | 12/1939 | Rinehart | 190/41 Z |
| 2,249,841 | 7/1941 | Loos | 190/44 |
| 2,672,903 | 3/1954 | Machinist | 150/28 R |
| 3,292,747 | 12/1966 | Dawson | 190/44 |

FOREIGN PATENT DOCUMENTS

| | | | |
|---|---|---|---|
| 1427400 | 3/1965 | France | 190/44 |
| 644486 | 10/1950 | United Kingdom | 190/44 |

*Primary Examiner*—Ro E. Hart

[57] ABSTRACT

A tailored, casual, soft bag that can be used as luggage for camping, sporting events, etc. with provision for approximately doubling its carrying capacity, the bag having a main body and a secondary body collapsibly carried within the main body, the secondary body being able to be withdrawn from the main body to approximately double the size of the bag, zipper closures of novel design being provided for both the main body and the secondary body.

5 Claims, 7 Drawing Figures

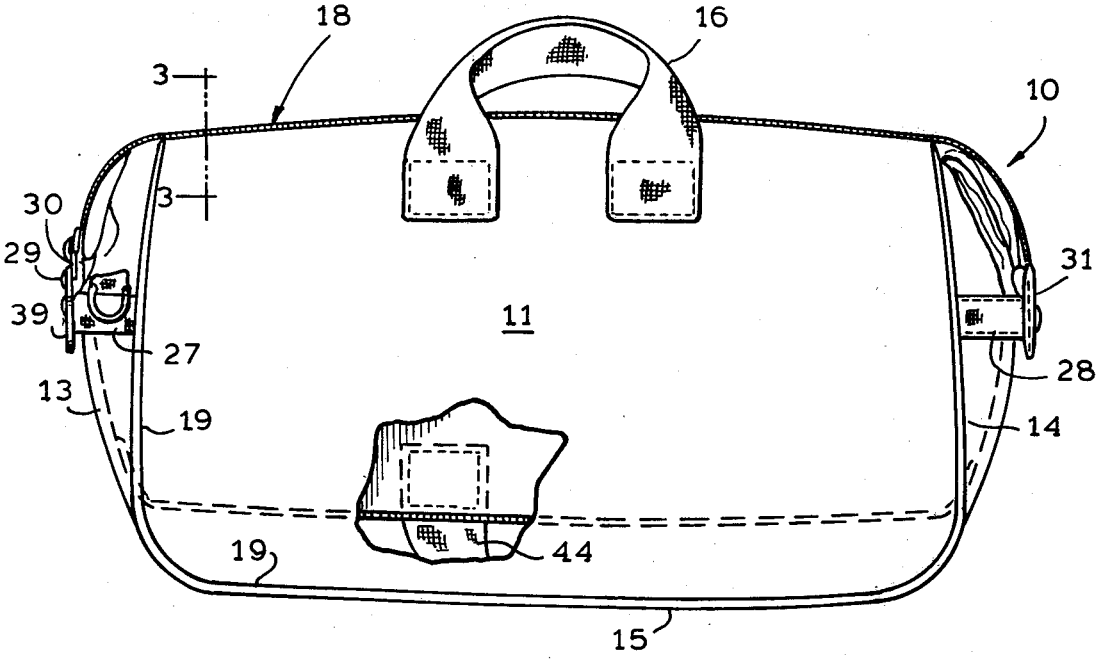
Fig. 1
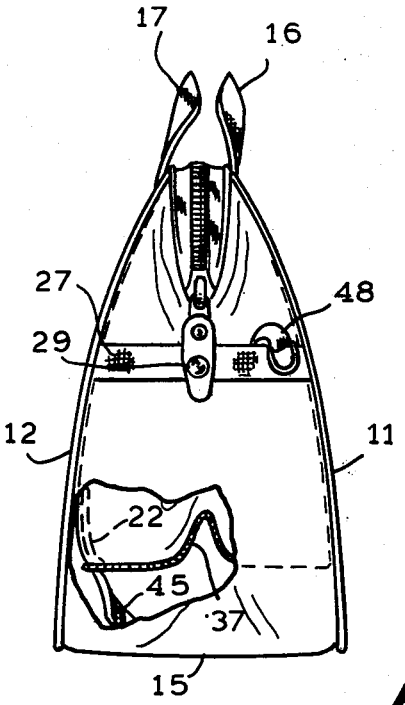
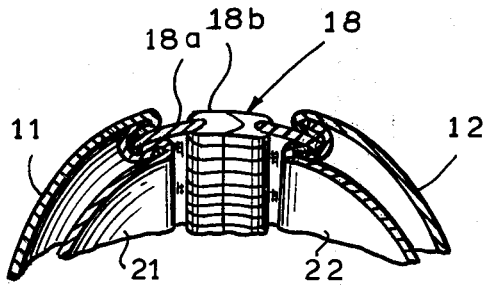
Fig. 3
Fig. 2

Fig. 5
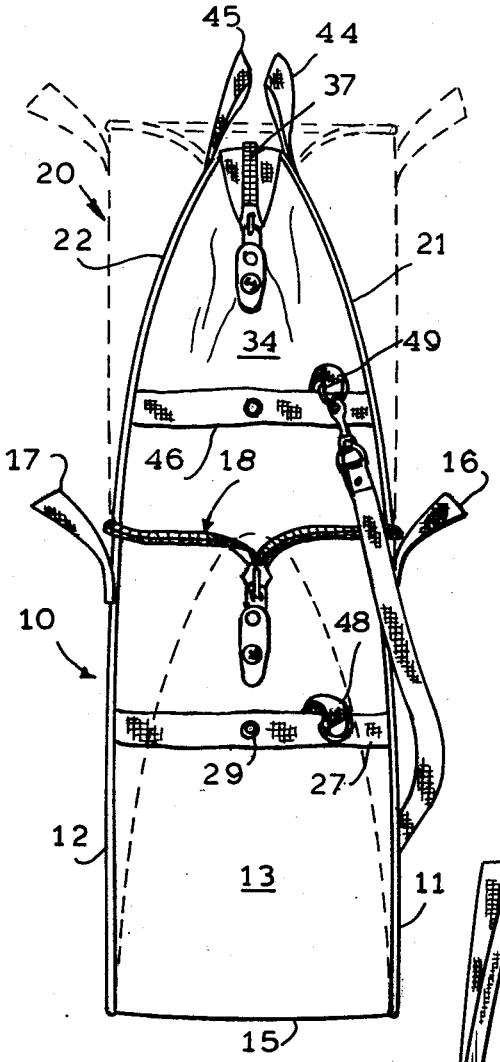
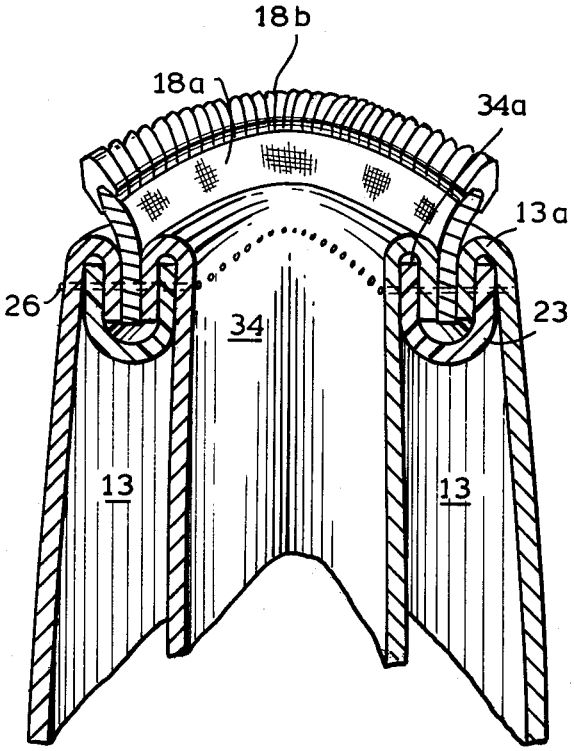
Fig. 6
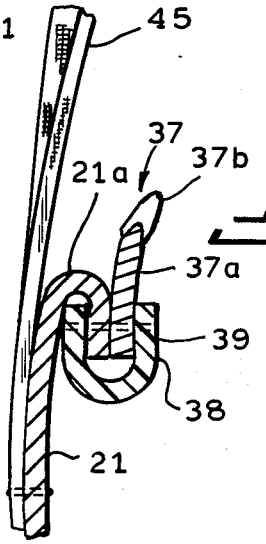
Fig. 7

EXPANDABLE LUGGAGE BAG

BACKGROUND OF THE INVENTION the present invention relates generally to bags wherein a principal or main body had folded or collasped within it a top or secondary bag section, which can be withdrawn to effectively double the capacity of the bag. Bags of this type have been disclosed in U.S. Pat. Nos. 3,229,741; 1,810,347; 2,212,390; and 2,729,257. Some of the foregoing include closure means for the respective main and secondary sections of the bag and other do not, while none of the collapsible/expandable bags heretofore known are suitable in a modern sense to be used as casual or sport type luggage. It is the purpose of the present invention to fulfill this need.

SUMMARY OF THE INVENTION

In accordance with the invention, an expandable bag constructed of flexible material has main section and secondary expansible section which is retained within the main section when the bag is in its non-expanded condition. Each of the main and secondary sections have two side panels and two end panels joining the side panels, and each of the main and secondary sections include a zipper closure member having mating halves secured to the upper periphery of the side and end panels. A zipper slide effects engagement of the mating halves of the zipper beginning at one end panel and ending at the opposite end panel, the start and finishing ends of the zipper projecting for a short distance beyond the respective side panels. A tab is connected to the starting end of the zipper to join the mating halves thereof, and another tab is connected to the zipper slide, each of the tabs being equipped with a fastening means such as a snap fastening means to permit drawing down the projecting zipper ends against the respective ends panel and securing the zipper ends in this position. Uniquely, the zipper closure members are each one-half of a conventional zipper assembly consisting of one continuous zipper from the startaing end about the peripheries of the main and secondary sections, with the starting ends being attached together by a tie-down tab. Additionally, the peripheries of the main and secondary sections are uniquely constructed to secure the zipper closure members to each periphery with great stability and strength.

BRIEF DESCRIPTION OF THE DRAWING

FIG. 1 is a side elevation of the bag of the present invention in its collapsed or compacted condition;

FIG. 2 is an end view of the bag shown in FIG. 1;

FIG. 3 is a section taken in the direction of arrows 1—3 of FIG. 1;

FIG. 5 is an end view of the bag in its extended condition;

FIG. 6 is a section similar to FIG. 3 except that zipper is in its opened condition;

FIG. 7 is a view taken in the direction of arrows 7—7 of FIG. 4.

DESCRIPTION OF A PARTICULAR EMBODIMENT

Figure 4:
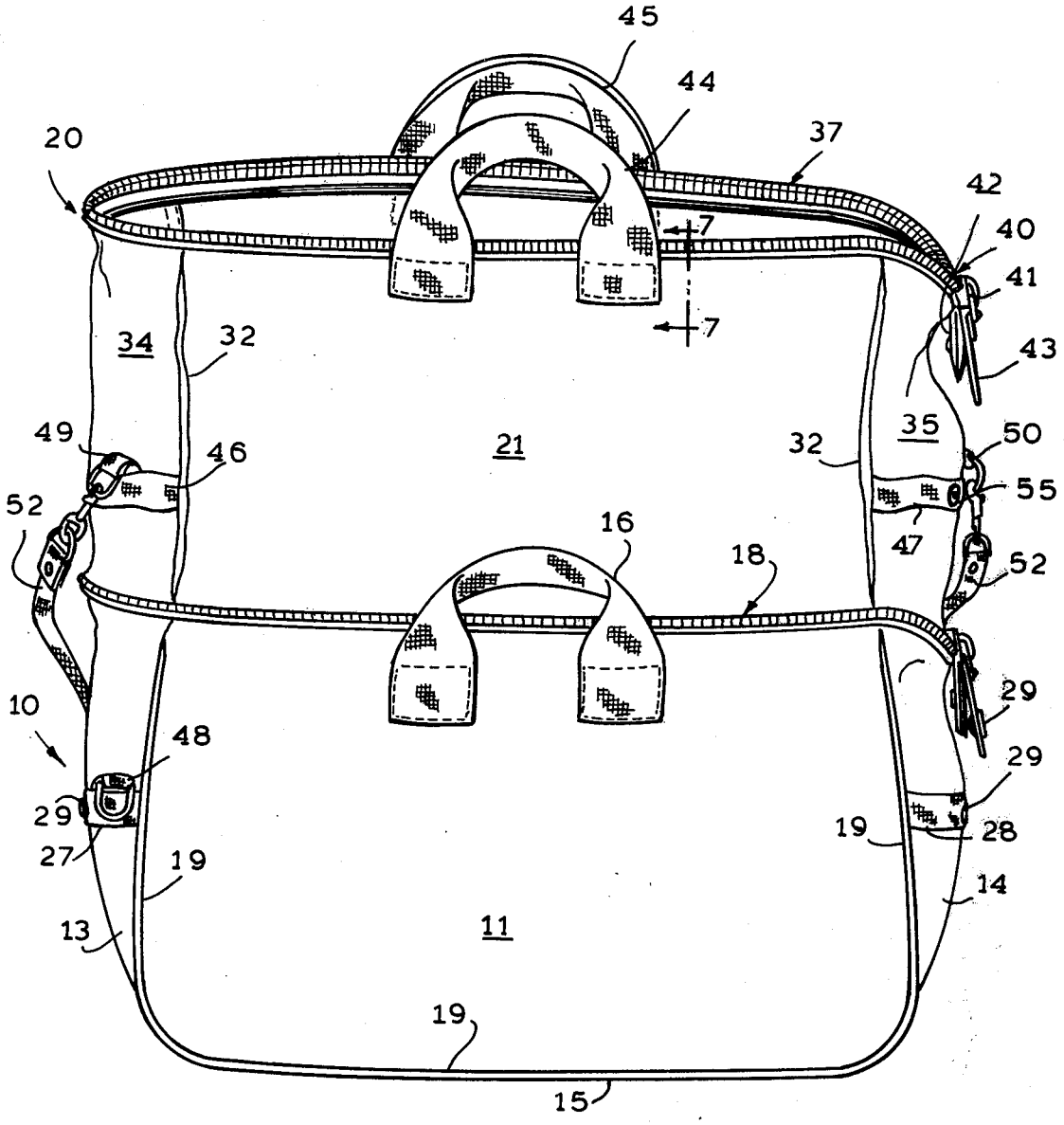
FIG. 4 is a side view of the bag of FIG. 1 in its extended condition.

Referring now to the drawing, a tailored, casual, soft bag that can be used as luggage, for camping, sport events, etc. incorporating the principles of the present invention has been illustrated. The bag, which is constructed throughout generally of flexible fabric material, has a lower main body 10 having side panels 11 and 12, which are joined to end panels 13 and 14 and a bottom panel 15 by welting 19, panels 13 through 15 being of a single piece of fabric. Handles 16, 17 are attached by stitching to the upper portion of side panels 11 and 12. The lower section 10 includes a zipper closure member 18 whose fabrication, assembly and attachmenet will be described in greater detail. Suffice it to say that the bag as shown in FIG. 1 can be used in its collapsed or compact condition to carry various articles therein and that the zipper closure 18 can be used to close the bag in its compact state with handles 16 and 17 serving for carrying purposes.

Referring to FIG. 6, it will be seen that the top of panel 13 is rolled over at **13*a* into an inverted U-shaped fold which is continuous (panels 11, 12 and 14 have similar folds) about the upper periphery of the lower or main bag section 10. A secondary bag section 20 having end panel 34 descends within the main body 10, the lower end of panel 34 being also formed in inverted U-shaped fold 34*a*. The bag section 20 comprises, in addition to panel 34, side panls 21 and 22 and opposite end panel 35 (joined together by welting 32), whose lower ends are rolled over into an inverted U-shaped fold and are continuously interconnected. Sandwiched between the depending U-shaped sections 13*a* and 34*a* is an upright U-shaped binding 23, and sandwiched as well between the facing inner sides of respective section 13*a* and 34*a* is the fabric supporting part 18*a* of the zipper 18 whose teeth 18*b* are attached thereto. The entire assembly of the parts just described are held together by stitching 26**.

The zipper 18 is actually one-half of a continuous coil zipper which has been split lengthwise by disengageing the teeth. the proper predetermined length of each zipper half is used respectively to form a closure for the lower main bag section and the upper section as will be described. In fabricating the closure for the lower section 10, one piece of half section of zipper is sewn to the top perimeter as shown in FIG. 6 all the way around leaving approximately two inches of zipper extended beyond one end of the assembly. As seen in FIG. 1, reinforcing bands 27, 28 are attached respectively to end panels 13 and 14, and one-half of a snap fastener 29 is mounted in each of the bands 27 and 28. A tab 31 containing the mating half of snap fastener 29 is attached to and interconnects the two ends of zipper 18 so that when the bag is in its closed position as shown in FIG. 1, the starting end of the zipper can be snapped down against each of the bands 27 and 28. The zipper slide 30 is similarly attached to a tab 39, including a snap fastener 29 which can be fastened to its mating half attached to the band 27. This provides a very pleasing, contoured profile to the bag since excess material at the periphery of sections 34 and 35 is folded down against these sections. Thus, the end sections 13, 14 and 34, 35 are quite full in the fully opened and fully expanded condition (see FIG. 4) enabling the bag to have more volume. Also, this construction permits ends panels 34 and 35 in effect to become extensions of panels 13 and 14 when the bag is fully extended.

Referring now to FIGS. 4 and 5, the bag in its extended condition has been illustrates. The construction of the secondary, expansible section 20 is essentially identical with the construction just described with respect to the main section 10, except of course that section 20 has end panels 34, 35 which are not interconnected by a bottom piece as is the case with the section 10. FIG. 7 illustrates the attachment of an upper zipper 37 wherein the upper periphery of side panel 21 is attached to the fabric section 37*a* of zipper 37, the parts being encapsulated by U-shaped binding 38. the entire assembly is stitched at 39 all around the top. It will be understood that this assembly is typical and that the upper edges of end panels 34 and 35 and of side panel 22 will be similarly attached to the zipper 37. As was the case with the lower section of the bag zipper 37, the other half of zipper 18 and the two ends thereof extend at 40 to be joined by tab 42. The slide 41 is attached to a tab 43, snap fasteners 55 being provided respectively on tabs 41, 43 and on bands 46, 47 to permit the securing of the opposite ends of the zipper 37 to each end panel 34 and 35.

Handles 44, 45 are attached to section 21 and 22; however, each of the bands 27 and 28 and 46 and 47 have attachments 48 through 50 adapted to be secured tp a shoulder strap 52 for easy carrying of the bag over the shoulder.

It will be observed particularly with respect to FIG. 5 that as shown by the dotted outline of the bag in its compact condition, the overall height of the bag in its fully extended condition is approximately twice that of the bag in its compacted condition. Furthermore, it can also be observed from the illustration of FIG. 5 that the volume or carrying capacity of the bag is easily doubled when the upper section 20 has been withdrawn from the lower section 10.

Furthermore, in constructing the bag of the present invention, great care was taken to construct the zipper closure members in a manner which secures them with great strength to each bag section. It will be observed that the zipper in each case has been sandwiched between adjacent members comprising the upper edges of respective bag sections symmetrically arranged and encapsulated by welting and that when these are stitched together, the entire assembly has great strength and stability. Finally, the upper section of the bag of the present invention is essentially a duplicate of the lower section which greatly contributes to its ease of manufacture. The technique of splitting a zipper into halves when using the respective halves as closure members is the main and secondary bag sections is thought to be quite unique as is the concept of tying down the starting and finishing ends of the zipper closure to the end panels in order to make a pleasing profile.

It will be understood that the foregoing description has been of a particular embodiment and is therefore merely representative. In order to fully understand the scope of the invention, reference should be made to the appended claims.

We claim:

1. In an expandable bag constructed of flexible material having a main section and a secondary, expansible section which is retained within the main section when the bag is in its non-expanded condition, the improvement comprising, said main section having a generally rectangular bottom panel, each of the main and secondary sections having two generally rectangular side panels and two generally rectangular end panels joining said side panels, the upper edges of said side and end panels defining together a horizontal opening such that in the fully opened position of each of the main and secondary sections the bag assumes an oblong configuration and in the fully closed position, said side panels collapse to permit progresive upward tapering of the bag, each of the main and secondary sections including a zipper closure member having mating halves secured to the upper periphery of side and end panels, a zipper slide to effect engagement of the mating halves of the zipper beginning at one end panel and ending at the opposite end panel, in the fully closed position the start and finishing ends of said zipper together with the upper underlying portions of said side panels projecting for a short distance laterally of each end of the bag, a tab connected to the starting end of the zipper to join the mating halves thereof, a tab connected to the zipper slide and fastening means connected to each of said tabs and to each side panel to permit drawing and securing the projecting upper ends of the side panels against an intermediate portion of the end panels, and wherein the zipper closure members are each one-half of a conventional zipper assembly, the finishing ends forming a continuous, closed loop.

2. The bag according to claim 1 wherein the main section has a bottom panel integrally connected to each of the main section side panels.

3. The bag according to claim 1 wherein the upper ends and the lower ends respectively of the side and end panels of the main section and of the secondary section are rolled over into a continuous, inverted, double, U-shaped periphery with depending free portions thereof facing each other, the zipper closure for the main section includes a fabric web to which zipper teeth are attached, the fabric web being sandwiched between said facing portions, a continuous, U-shaped binding each leg of which lies between one of the inverted rolled over ends of the aforementioned side and end panels, and means for securing together the panel ends, the zipper fabric web and welting to form a closure for the main section while the side and end panels of the secondary section are free to depend from the periphery of the main section within the main section and to be withdrawn therefrom.

4. The bag according to claim 3 wherein the upper ends of the side and end panels of the secondary section are rolled over into a continuous, inverted U-shaped periphery, the zipper closure for the secondary section includes a fabric web to which zipper teeth are attached, the fabric web being positioned adjacent to and inwardly of the rolled-over periphery, a U-shaped binding one leg of which lies within the rolled-over periphery and the other encompassing the fabric web, and means for securing together said periphery, said fabric web and said welting.

5. The bag according to claim 4 wherein each section has handles attached thereto, each of said side panels includes reinforcing horizontal bands mounting one-half of a snap fastener, the other half being mounted to the depending ends of said tabs whereby said tab ends can be secured to said bands to draw down the zipper ends to effect a pleasing, contoured profile.

* * * * *